United States Patent [19]

Fenyvesi

[11] Patent Number: 4,848,455

[45] Date of Patent: Jul. 18, 1989

[54] FLEXIBLE DRILL ROD FEEDING APPARATUS FOR QUICK ROTARY DEEP DRILLING

[76] Inventor: János Fenyvesi, Csobogos u.7, Budapest XV, Hungary

[21] Appl. No.: 126,236

[22] Filed: Nov. 27, 1987

[51] Int. Cl.[4] ..... E21B 3/02; E21B 19/08

[52] U.S. Cl. ..... 166/77; 166/78; 166/237; 166/384; 175/203; 175/220

[58] Field of Search ..... 175/203, 220; 166/77, 166/77.5, 78, 237, 380, 384; 173/46

[56] References Cited

U.S. PATENT DOCUMENTS

| | | | |
|---|---|---|---|
| 3,321,016 | 5/1967 | Lance | 166/237 X |
| 3,559,905 | 2/1971 | Palynchuk | 166/77 X |
| 3,724,567 | 4/1973 | Smitherman | 166/77 X |
| 4,655,291 | 4/1987 | Cox | 166/77.5 X |
| 4,660,634 | 4/1987 | Johnson, Jr. | 166/77.5 |
| 4,735,270 | 4/1988 | Fenyvesi | 166/77 X |

*Primary Examiner*—Stephen J. Novosad
*Attorney, Agent, or Firm*—Herbert Dubno

[57] ABSTRACT

A drill rod apparatus for quick rotary deep drilling has its drill pipes connected by flexible joints so that the rotation of a nut relative to a housing of each joint permits separation of the pipe ends connected thereby and the arrays of interengageable claws. The housing is connected to one of the pipes by a ball and socket joint so that with such separation, while a seal is maintained between the interiors of the two pipes, one pipe can be angularly offset from the other by substantially as much as 30°.

12 Claims, 4 Drawing Sheets

FLEXIBLE DRILL ROD FEEDING APPARATUS FOR QUICK ROTARY DEEP DRILLING

CROSS REFERENCE TO RELATED APPLICATION

This application is related to my copending application Ser. No. 06/872,667 filed Aug. 30, 1985 (as PCT/HU85/00052), now U.S. Pat. No. 4,735,270.

FIELD OF THE INVENTION

The invention relates to a flexible rod feeding apparatus for quick rotary deep drilling. The apparatus makes it possible to raise the assembled drill rod from the drill hole without disassembly, if the drill head becomes damaged and has to be replaced, to store the assembled drill rod around the unit moving the drill rod while exchanging the drill head and, after the drill head has been changed; to lower the drill rod thus assembled into the drill hole.

BACKGROUND OF THE INVENTION

It is a well known fact hat deep drilling usually employs drill rods which are stiffly assembled from drill pipes and threaded pipe nipples. Upon rotation of the drill rod in one direction, threaded pipe nipples are able to transfer the torque.

The main disadvantage of rotary deep drilling performed with a drill rod as thus rigidly assembled is the slow operation, as is especially the case when frequent replacement of the drilling head is required. Then the drill rod must be disassembled into pieces and must be reassembled after the replacement of the drilling head The drilling apparatus as disclosed in the U.S. Pat. No. 3,724,567 was developed for enhancing the quick drilling operation and avoiding frequent disassembly and assembly so that the drill rod can be raised from the drill hole without disassembling the drill rod. The drill rod can be laid into the series of carriages on a circular path with a diameter of about 100 m next to the boring tower, the carriages and path forming so-called drill rod receiver. The size of the drill rod receiver (i.e. storing unit) cannot be reduced, because the rigid drill rod is unable to tolerate increased bending without getting damaged. Moreover, due to the large dimensions and heavy weight of the apparatus, expensive drilling islands had to be developed for submarine drilling using it.

The Hungarian Patent Application (filed 4.09.1984) Ser. No. 3318/84 is also prior art and, discloses a continuously operated deep drilling apparatus for rotary deep drilling having two feed chains facing one another. The feed chains press the drill rod and rotate it via a rotary table. The feed chains also axially displace the drill rod up and down. This equipment enables assembly of the drill rod continuously from the drill pipes simultaneously with the drilling motion of the drill rod. This arrangement eliminates need for a tower and facilitates accelerated deep drilling while avoiding danger of tilting of the rod. However as in other known systems, he drill rod must be disassembled, e.g. into sections each consisting of a plurality of drill pipes if the drilling head is to be replaced. Thus in this case as well, there is the disadvantage that screwing and unscrewing of the drilling pipes require a considerable expenditure on labor connected with a significant loss of time.

The art has tried to eliminate deficiencies of the aforedescribed apparatus by deep drilling with hoses whereby drill rod is replaced by an endless flexible hose releaseable from a drum. In this case, means had to be provided for revolving the drilling head separately.

The principle of drilling the hole with a drilling motor or with a turbine is also known; however, these methods are unsuitable for deep drilling to depths of several thousands of meters.

OBJECT OF THE INVENTION

The object of the invention is to provide a deep drilling apparatus which eliminates deficiencies of the prior art systems while enabling continous deep drilling and the use of a preassembled drill rod which makes it possible to avoid any interruption during pipe-joining movements

SUMMARY OF THE INVENTION

We have found that the elements of the drill rod lying outside the drill hole need not be separated or disassembled, while the assembled drill rod can be stored on the surface in one-third area of the former storing areas, when the drill pipes are provided with a flexible pipe nipple, which disables the drill only to the extent that rotary motion cannot be transferred but maintains the axial connection in a well-sealed manner.

In accordance with the invention quick rotary deep drilling is effected with an apparatus in which the drill rod is assembled of drill pipes and flexible pipe nipples. The end of one of the drill pipes—meeting an adjoining drill pipe in one of the pipe nipple—is provided with claws and a spherocylinder or with a connection profile carrying the spherocylinder, while the end or the other drill pipe is provided with claws and a nut moving the drill pipe axially. The spherocylinder is enclosed in an articulated construction The nut is engageable by a device arranged for turning the nut and for compressing the drill pipes or loosening.

The drill pipe is provided with a connection profile which—due to its small overall dimensions—can be produced with small-sized machine tools and can be fixed to the drill pipe by welding.

Spherocylinders are clamped expediently in the articulated means (e.g. ball-and-socket joints) by using ball-halves,—known also as compression members—because in this way the angle enclosed by the adjacent drill pipes can be large, even 30° in an open state.

The claws transmitting the torque of the adjacent drill pipes have a trapezoidal shape towards the base point of the pipes and are arranged on the periphery of the drill pipes and the connection profile, respectively, symmetrically and in telescopic interpenetration relationship to ensure full connection of the pipes.

Following the separation of the claws leakage of the flushing liquid can be prevented by using pressure-tight sealing elements between the drill pipes.

Connection and disconnection of the claws can be expediently realized by screwing a nut which is fixed to the drill pipe by means of turnable carrier elements, while its outer periphery is formed as a polygon, so as to be able to fit to the forks of the fork wrench, and when coming into contact with the thread of the threaded house surrounding the articulated means, it moves the drill pipe axially.

It is considered, as advantageous, if the unit for turning the nut is fixed to the steel structure carrying the chain drive and provided with orienting blades for determining the position of the drill pipes, as well as with forks, which can be fixed rotatably to the plate carrying the forks. Fork arms can be urged by springs against the polygonal nut.

The nut turning unit can be moved horizontally and vertically by means of the fork carrier plate having been connected to the hydraulic working cylinder and fixed to a vertical slide and which is connected with a horizontal slide which can be moved by another hydraulic working cylinder.

The length of drill rod, having been preassembled from the drill pipes and lying on the ground cnn be stored on a storing unit, which is provided with a casing arranged around the chain drive which moves the drill rod.

A pipe-laying frame carrying the drill rod guiding pipe can be attached to the carriage moving on the rails along the casing and which places the drill pipe in the casing.

Expediently the casing is formed from a steel sheet bent to the shape of the trough and arranged along the periphery of the circle with a max. diameter of 50 m.

BRIEF DESCRIPTION OF THE DRAWING

The invention will be described in greater detail with reference to the accompanying drawing in which.

SPECIFIC DESCRIPTION

Figure 1:
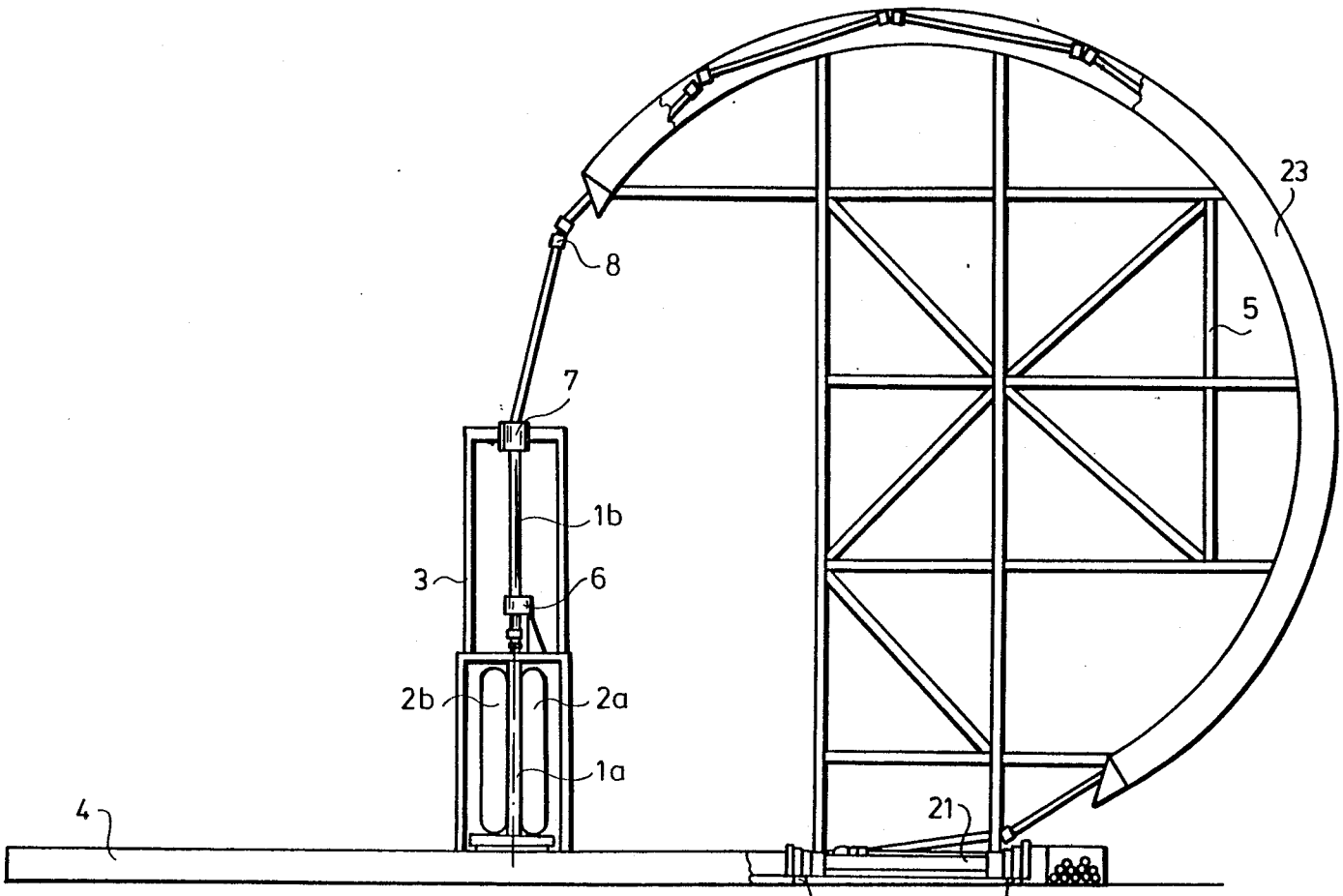
FIG. 1 is a partial sectional side view of the apparatus.

As can be seen from FIG. 1, the drill pipe of the drill rod is engaged in the chain drive 2*a*, 2*b* moving the drill rod. The chain drive 2*a*, 2*b* is enclosed by the steel pipe guide 3. Drill rod 1*a* is connected to the drill pipe 1*b*, and it is led through the nut turning means 6 fixed to the steel pipe guide 3. The pipe guiding roller 7 is also fixed to the steel pipe guide 3, this guiding roller feeds the drill pipes in a centralized way into the chain drive 2*a*, 2*b* which displaces the drill rod. The individual drill pipes are interconnected by pipe nipples 8, which—due to the articulated design—enables the axes of the drill pipes following one another to make angles of 30° with each other. The polygonal drill rod assembly thus formed is passed through the drill rod guiding pipe 23—arranged on the pipe-lying frame 5—into a casing 4. In the present case the casing 4 is a trough formed of a steel sheet. On the rails 22*a*, 22*b* the carriage 21 travels along the casing 4. The carriage carries the pipe-laying frame 5.

Figure 2:
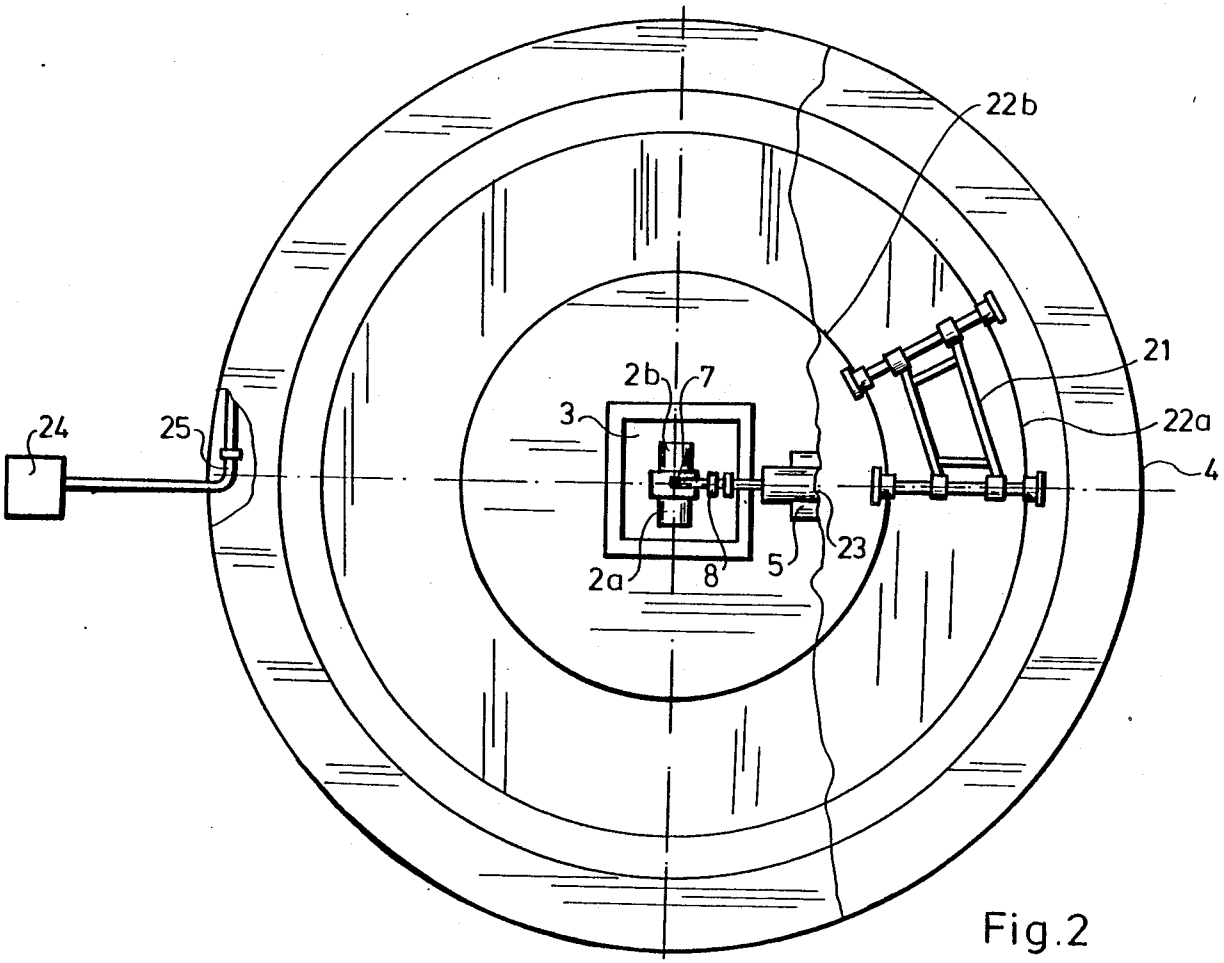
FIG. 2 is a partial sectional top view of the apparatus.

FIG. 2 shows the biaxial carriage 21 travelling on the rails 22*a*, 22*b* along the casing 4. The end of the drill rod lying in the casing 4 is connnectèd via the pipe nipple 25 to the flash pump 24.

Figure 3:
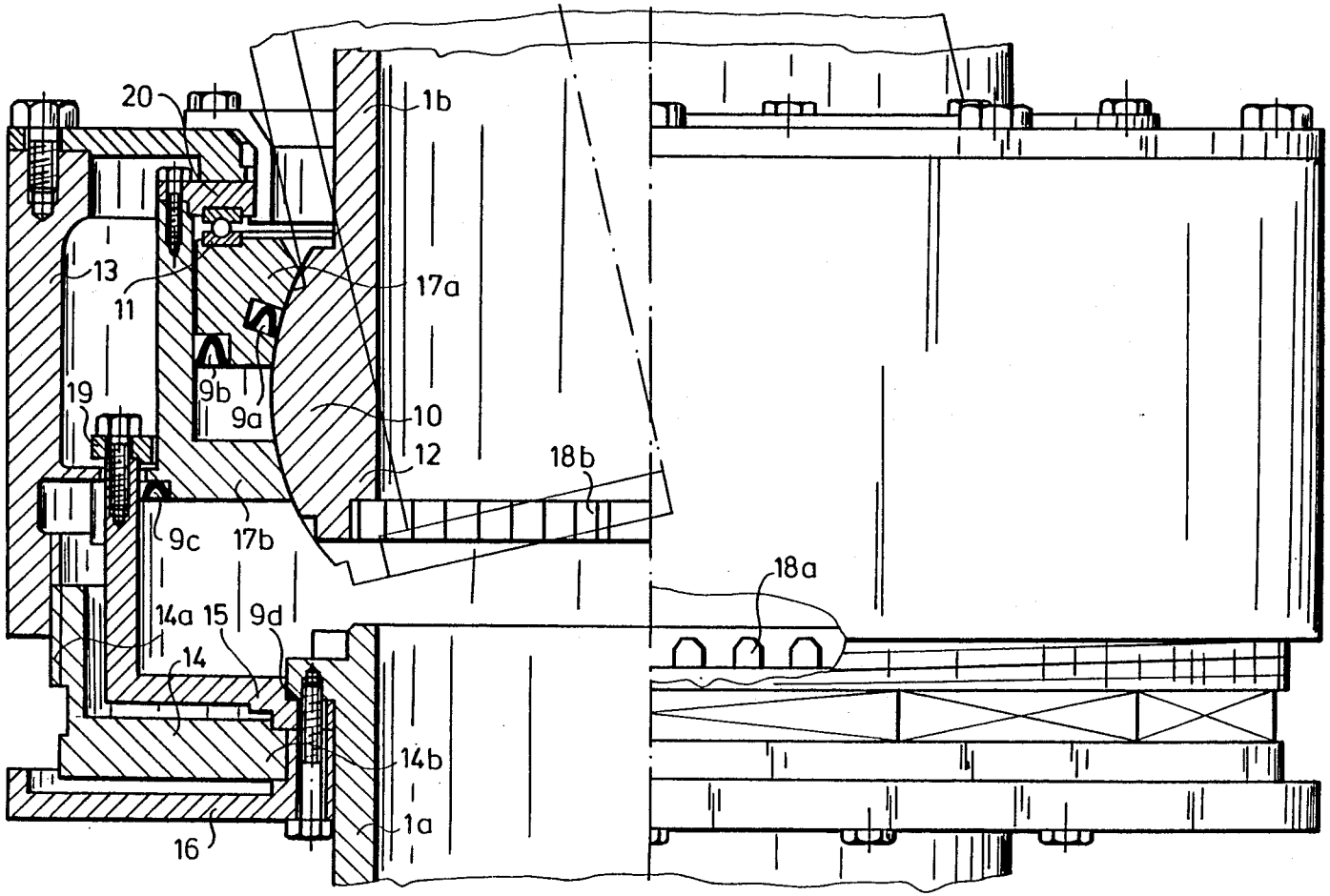
FIG. 3 is a partly a side view and partly a sectional view of the pipe connection, drawn to a larger scale.

As can be seen from FIG. 3, the pipe nipple with the ball-and-socket joint is arranged in a threaded housing 13, which receives the connection profile 12 welded to the drill pipe 1*b*. The connection profile is provided at the bottom with trapezoidal claws 18*b* equally spaced about the edge of the profile 12, while on the side thereof the spherical segment 10 is provided. Spherical segment 10 is enclosed by the spherical segmented half seats 17*a*, 17*b*. To prevent leakage of the flushing liquid contained in the drill pipes 1*a*, 1*b* of the drill rod sleeved sealing elements 9*a* and 9*b* are received in the spherical half seat 17*a*. Between the spherical half seat 17*a* and the carrier flange 20 fixed to the threaded housing 13 there a thrust bearing 11 is arranged to assure smooth rotary motion.

Figure 4:
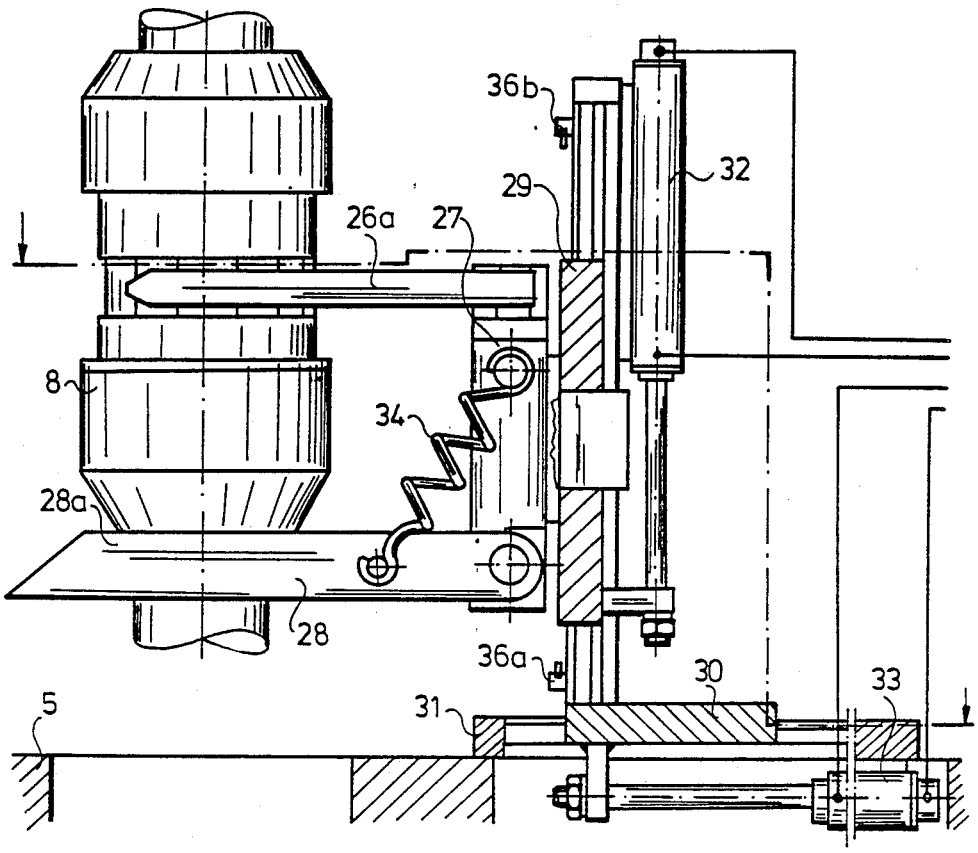
FIG. 4 is a partial sectional side view of the nut turning means.
Figure 5:
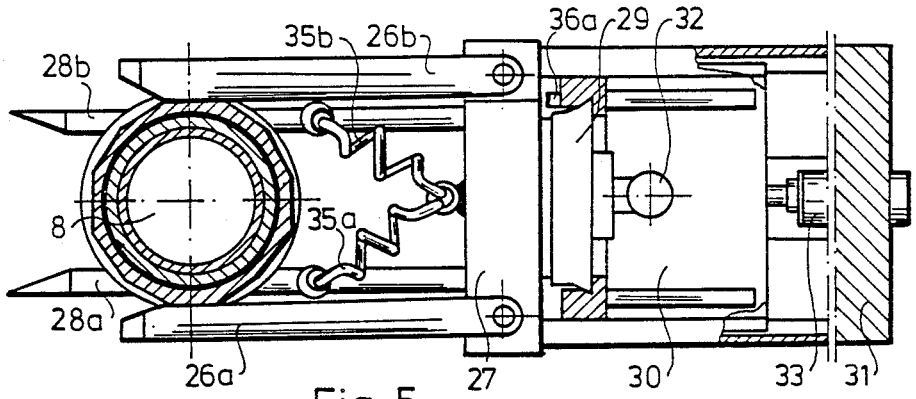
FIG. 5 is a section along the line A—B of FIG. 4.

The end of the drill pipe 1*a* is also provided with claws 18*a*. On the side of pipe 1*a* the polygonal nut 14 is fixed with the carrier elements 15 and 16. The nut 14 is formed with the shoulder 14*b* and thread 14*a*. The shoulder 14*b* contacts the carrier elements 15 and 16, while the thread 14*a* engages the threaded housing 13. Between the upper part of the carrier element 15 and the spherical half seat 17*a* the sleeved sealing element 9*c* is inserted, whereas between the lower part and the side of the drill pipe 1*a* with "O"-ring sealing element 9*d* is arranged. A stop ring 19 is attached by screws to the upper end of the carrier element 15 and prevents complete separation of the drill pipes, 1*a*, 1*b* by engagement with the spherical half seat 17*b*. The claws 18*a*, 18*b* of the drill pipes 1*a*, 1*b*, upon interdigitation, can transmit the torque. When the claws pull apart, the spherical seat and profile permit swivelling The fork arms 26*a* and 26*b* of the nut turning means—as can be seen in FIGS. 4 and 5—are drawn by the springs 35*a* and 35*b* against the polygonal nut 14 of the flexible pipe nipple 8. These springs 35*a* and 35*b* are fixed elastically, and foldably to the fork carrier plate 27, which again is attached to the vertical slide 29 which can be rotated through 180°. the vertical slide 29 is able to slide on a slide way of the horizontal slide 30. The slide 30 can slide in the table 31. The vertical slide 29 is moved by the hydraulic actuating cylinder 32, while the horizontal slide 30 is moved by the hydraulic actuating cylinder 33. The nut turning means is oriented or adapted to the position of the drill pipe by means of the orienting blades 28*a* and 28*b* which are also fixed to the fork carrier plate 27 and pressed by the springs 34 to the drill pipe.

At the bottom and at the top, the limit switches 36*a* and 36*b* are fixed in the path of the slide 29.

The pipe nipple 8 wih the ball-and-socket joint operates as follows:

Starting from the open position of the claws 18*a*, 18*b*, the polygonal nut 14 is rotated by the nut turning means 6 relative to the threaded housing 13, to cause the claws 18*a* and 18*b* to slide into each other, their trapezoidal shapes promote the connection. The lower drill pipe 1*a* is rotated by the chain drive 2*a*, 2*b*, which puts the drill rod into motion.

After the claws 18*a*, 18*b* have been pulled together, the flexible pipe nipple 8 will be well sealed, able to take up axial forces, and able to transfer the torque.

Upon rotation of the polygonal nut in the opposite sense, i.e. after the claws 18*a*, 18*b* have been pulled apart, the flexible pipe nipple 8 will be well sealed, able to take up an axial force, able to perform a relative angular displacement of 15°–30° between drill pipes, and incapable of transmitting torque.

The nut turning means operates as follows:

Claws 18*a*, 18*b* are interconnected to each other, the continuously operating chain drive 2*a*, 2*b* moving the drill rod allows the drill rod to sink axially into the bore hole, while the lower 1 drill pipe is rotated clockwise. Taking into consideration that the polygonal nut 14 of the flexible pipe nipple 8 has a right-hand thread, the upper drill pipe 1*b* does not move. The vertical slide 29 occupies its upper position. The operator activates the horizontal slide 30 with the hydraulic working cylinder 33, which is pushed forward to such an extent only, that the points of the orienting blades 28*a*, 28*b* should reach the centerline of the pipe nipple 8. As it travels downwards, the pipe nipple 8 impacts on the orienting blades 28*a*, 28*b* and begins to pull downwards the nut turning means 6 together with the vertical slide 29. As soon as the vertical slide 29 leaves the limit switch 36*b*, an electric signal is supplied to the hydraulic working cylinder 33 which advances the nut turning means 6 to the pipe nipple 8. Since the polygonal nut 14 lies at the same distance from the bottom of the pipe nipple 8, whether it is open or closed and this distance never changes, the fork arms 26*a*, 26*b* are pushed onto the nut 14. These arms clamp the nut 14, as a consequence, the nut 14 pulls the drill pipes 1*a*, 1*b* together and the claws 18*a*, 18*b* get in telescopic interpenetration.

At the engagement of the pipe ends, i.e. when fully closed, the springs 35*a* and 35*b* allow the fork arms 26*a*, 26*b* to unfold.

The pipe nipple 8 travelling downwards carries the nut turning means 6 with itself until the vertical slide 29 reaches the lower limit switch 36*a*, which supplies an electric signal to the hydraulic actuating cylinders 32, 33. Upon receipt of the latter signal, the hydraulic actuating cylinders carry the nut turning means 6 into the opposite end positions. In such a manner the closing cycle is finished, the other pipe nipples are closed in a similar way.

For pulling the claw connection apart, the fork carrier plate 27 is swung by 180° around its axis and fixed in this position. The vertical slide 29 is allowed to pass into the lower position by means of the hydraulic actuating cylinder 32; from this point the operation are the same, as in course of the closing manipulation. The vertical slide 29 is moved by the pipe nipple 8 also in course of opening.

As it becomes obvious from the embodiment described, the chain drive 2*a*, 2*b* belonging to the apparatus, by the aid of which clockwise and counter-clockwise revolutions can be performed, enables the use of the flexible pipe nipple 8, and a consequence, to store the drill rod without being disassembled on a circular arc with a diameter of about 30 m.

A surprising additional advantage experienced by the use of the apparatus according to the invention lies in that the drill head can be rotated in two directions, as in constrast to known solutions the pipe nipple 8 is able to transfer the torque in both directions. Accordingly, the drilling head is suitable for drilling a double depth, generally without the need for replacement of the drilling head.

What we claim is:

1. A drill rod apparatus for quick rotary deep drilling, comprising:

a flexible drill rod comprising:

a plurality of drill pipes, and respective flexible joints interconnecting said pipes, each of said joints including:

an array of claws formed on an end of one of said pipes, an array of claws formed on an end of another of said pipes to be joined to said one of said pipes by the respective joint and interfitting with the claws of said one of said pipes upon axial approximation of said one and said other pipes to enable torque transmission therebetween, a spherocylindrical formation surrounding said one of said pipes at said end thereof, a housing formed with a spherical segmental seat engaging said formation and enabling angular offsetting of said one and said other pipes upon axial separation of said arrays of claws, and a nut engaged with said other pipe, threaded into said housing and positioned, upon relative rotation of said housing and said nut, to cause axial displacement of said ends together to enable said claws to interfit and axial displacement of said claws apart to permit separation of said arrays of claws and angular offsetting of said one and said other pipes;

a chain drive comprising a pair of endless chains receiving said rod between them for axially displacing said drill rod and rotating same; and nut turning means engageable with said nut and located above said chain drive for enabling relative rotation of said nut and said housing for axially displacing the ends of the pipes at each of said joints together and apart for interconnection of the claws and separation of said claws, respectively.

2. The drill rod apparatus defined in claim 1 wherein said spherocylindrical formation is a member welded onto said one of said pipes at said end thereof.

3. The drill rod apparatus defined in claim 1 wherein said spherical segmental seat is formed by a pair of spherical segmental seat halves engaging said spherocylindrical formation.

4. The drill rod apparatus defined in claim 1 wherein said claws have trapezoidal shapes and taper toward ends of said claws.

5. The drill rod apparatus defined in claim 2 wherein the claws of each array are arranged symmetrically along peripheries of the respective ends and the claws of the arrays are interdigitated wherein said one and said other pipes extend coaxially with one another, said arrays being coaxial with said one and said other pipes.

6. The drill rod apparatus defined in claim 1 further comprising a seal between said seat and said formation and at least one further seal in said housing for sealing said seat relative to the remainder of said housing, said seals being pressure resistant.

7. The drill rod apparatus defined in claim 1 wherein said nut is received between carrier elements connected to said other pipe.

8. The drill rod apparatus defined in claim 1 wherein said housing encloses said spherical segmental seat and said spherocylindrical formation.

9. The drill rod apparatus defined in claim 1 further comprising a steel pipe guide carrying said chain drive, said nut turning means being mounted on said steel pipe guide.

10. The drill rod apparatus defined in claim 1 wherein said nut turning means further comprises a fork having arms engageable with said nut, springs drawing said arms against said nut, a fork carrier plate carrying said fork, a vertical slide carrying said fork carrier plate, a horizontal slide carrying said vertical slide, respective hydraulic cylinders connected to said slides for displacing same, and orienting blades on said vertical slide for positioning said fork in alignment with said nut and engageable with a respective one of said flexible joints.

11. The drill rod apparatus defined in claim 1 further comprising a drill rod storing unit provided with a casing and receiving the drill rod upon separation of the arrays of claws of said flexible joints, said casing being connected to a pipe laying frame provided with a drill rod guiding pipe.

12. The drill rod apparatus defined in claim 1 wherein said casing is a steel sheet trough and said frame has a circular configuration with a maximum diameter of 50 m.

* * * * *